US008866394B2

(12) United States Patent
Wu et al.

(10) Patent No.: US 8,866,394 B2
(45) Date of Patent: Oct. 21, 2014

(54) DRIVE CIRCUIT FOR REALIZING ACCURATE CONSTANT CURRENT OF MULTIPLE LEDS

(75) Inventors: Xinke Wu, Hangzhou (CN); Liang'an Ge, Hangzhou (CN)

(73) Assignee: Inventronics (Hangzhou) Co., Ltd., Hangzhou, Zhejiang (CN)

( * ) Notice: Subject to any disclaimer, the term of this patent is extended or adjusted under 35 U.S.C. 154(b) by 181 days.

(21) Appl. No.: 13/519,476

(22) PCT Filed: Dec. 9, 2010

(86) PCT No.: PCT/CN2010/079600

§ 371 (c)(1),
(2), (4) Date: Jun. 27, 2012

(87) PCT Pub. No.: WO2011/079701

PCT Pub. Date: Jul. 7, 2011

(65) Prior Publication Data

US 2012/0286678 A1 Nov. 15, 2012

(30) Foreign Application Priority Data

Dec. 28, 2009 (CN) ..... 2009 1 0155848

(51) Int. Cl.
*H05B 37/00* (2006.01)
*H05B 33/08* (2006.01)
*H05B 37/02* (2006.01)

(52) U.S. Cl.
CPC ..... *H05B 33/0815* (2013.01); *H05B 37/02* (2013.01); *H05B 33/0818* (2013.01)
USPC ..... 315/188; 315/224; 315/274; 315/294

(58) Field of Classification Search
CPC ..... H05B 33/0818; H05B 33/0827; H05B 37/02; H05B 41/16; H05B 41/2822; H05B 41/2827
USPC ..... 315/188, 192, 212, 219, 224, 274, 276, 315/291, 294, 299, 312
See application file for complete search history.

(56) References Cited

U.S. PATENT DOCUMENTS 7,408,308 B2 * 8/2008 Sawada et al. ..... 315/291
2008/0252229 A1 10/2008 Wu (Continued)

FOREIGN PATENT DOCUMENTS

CN 1790887 A 6/2006
CN 1901373 A 1/2007

(Continued)

OTHER PUBLICATIONS

International Search Report (in Chinese with English translation) and Written Opinion (in Chinese) for PCT/CN2010/079600, mailed Mar. 10, 2011; ISA/CN.

(Continued)

*Primary Examiner* — Tung X Le
(74) *Attorney, Agent, or Firm* — Harness, Dickey & Pierce, P.L.C.

(57) ABSTRACT

A drive circuit for realizing accurate constant current of multiple LEDs is disclosed. The drive circuit comprises a high-frequency impulse Alternating Current (AC) power carrying N circuit units with same structure. Each of the circuit unit comprises a rectifier filter circuit, a blocking capacitor C1 and two LED loads. The rectifier filter circuit comprises two independent half-wave rectifier circuits, and two filter capacitors. Each of the two half-wave rectifier circuits comprises two diodes connected in series to supply power for the corresponding LED load. The filter capacitor is connected in parallel with the two ends of an LED load respectively, and the blocking capacitor C1 is connected in series with the input end of the rectifier filter circuit. The circuit also comprises N−1 equalizing transformers, each of which connects in series between two adjacent circuit units. A drive circuit for constant output current of multiple LEDs with high efficient, low cost and great flow equalization is provided in the embodiment of the invention. When the differential voltage of the two LED loads is large, high efficiency can also be achieved.

11 Claims, 9 Drawing Sheets

(56) References Cited

U.S. PATENT DOCUMENTS

| | | | | |
|---|---|---|---|---|
| 2008/0296972 | A1 | 12/2008 | Lee et al. | |
| 2010/0001661 | A1 * | 1/2010 | Huang et al. | 315/294 |

FOREIGN PATENT DOCUMENTS

| | | | |
|---|---|---|---|
| CN | 101511136 | A | 8/2009 |
| CN | 101778506 | A | 7/2010 |
| CN | 201708976 | U | 1/2011 |
| CN | 102437744 | A | 5/2012 |

OTHER PUBLICATIONS

Notification of the First Office Action regarding Application No. CN200910155848.0 dated Jul. 3, 2012. Partial translation provided by Unitalen Attorneys of Law.

* cited by examiner

DRIVE CIRCUIT FOR REALIZING ACCURATE CONSTANT CURRENT OF MULTIPLE LEDS

This application is a National Stage application of international application PCT/CN2010/079600 filed on Dec. 9, 2010, which claimed the benefit of Chinese patent application No. 200910155848.0 filed on Dec. 28, 2009. Both the international application and the Chinese application are incorporated herein by reference in their entireties.

FIELD OF THE INVENTION

The present invention relates to a driving circuit for precise constant-current control of multiple LED branches, and in particular to a circuit for current balancing between LED loads with a balancing capacitor.

BACKGROUND OF THE INVENTION

Generally, a multipath constant-current control driver for LEDs can be implemented with: 1. a constant-voltage module together with multiple non-isolated DC/DC constant-current circuits (e.g., BUCK circuits); or, 2. a voltage-adjustable voltage regulating module together with multiple linear regulating constant-current circuits.

As shown in FIG. 1, in the first scheme, the output of the constant-voltage module is inputted to the constant-current circuits, and each of the constant current circuits performs constant-current control independently, which can easily ensure the balancing between output currents. However, there is normally a significant disparity between the voltage of the constant-voltage module and the voltage across an LED load; therefore none of the DC/DC constant-current circuits after the constant-voltage module has high efficiency. In addition, the cost of the multipath constant-current control circuit is high.

As shown in FIG. 2, in the second scheme, MOS transistors or triodes are used to carry out linear regulation and hence multipath constant-current control. The output voltage of the voltage regulating module follows the linear regulating constant-current circuits after it, so that the output voltage of the voltage regulating module remains slightly higher than the highest one of the output voltages of the linear regulating constant-current circuits; as a result, power consumption of each of the linear regulating constant-current circuits remains close to the minimum while precise constant-current control is achieved. This scheme has the advantages including low cost of the circuit and good current balancing between the LED loads. However, as one of the most common ways for an LED to fail, short circuits may cause a significant disparity between the voltages across the LED loads, which leads to high power consumption at the linear regulating devices and hence a large amount of heat generated by the LED driver.

SUMMARY OF THE INVENTION

In view of the problems above, the present invention provides a multipath output, constant-current driving circuit for LEDs with high efficiency, low cost and good current balancing, which can achieve high efficiency even when the difference between the voltages across LED loads is large.

According to an embodiment of the present invention, a driving circuit for precise constant-current control of multiple LED branches is provided, including: a high-frequency pulse Alternating Current (AC) current source, and a circuit unit provided for the high-frequency pulse AC current source, wherein the circuit unit includes a rectification and filtering circuit, a balancing capacitor C1 and two LED loads;

the rectification and filtering circuit includes two independent half-wave rectification circuits and two filter capacitors; each of the half-wave rectification circuits includes two diodes connected in series, for supplying electric power to one of the LED loads; each of the LED loads is connected in parallel with one of the filter capacitors; the balancing capacitor C1 is connected in series with an input terminal of the rectification and filtering circuit.

Preferably, the rectification and filtering circuit includes a diode D1, a diode D2, a diode D3, a diode D4, a filter capacitor C2 and a filter capacitor C3;

a first input terminal of the rectification and filtering circuit is common to both an anode of the diode D1 and a cathode of the diode D2, and a second input terminal of the rectification and filtering circuit is common to both an anode of the diode D3 and a cathode of the diode D4; the balancing capacitor C1 is connected in series with one of the input terminals of the rectification and filtering circuit;

a positive terminal of a first LED load is connected with a cathode of the diode D1, and a negative terminal of the first LED load is connected with an anode of the diode D2; a positive terminal of a second LED load is connected with a cathode of the diode D3, and a negative terminal of the second LED load is connected with an anode of the diode D4;

the anode of the diode D2 is connected with the anode of the diode D4; the filter capacitors C2 and C3 are connected in parallel with the two LED loads respectively.

Preferably, the rectification and filtering circuit includes a diode D1, a diode D2, a diode D3, diode D4, a filter capacitor C2 and a filter capacitor C3;

a first input terminal of the rectification and filtering circuit is common to both an anode of the diode D1 and a cathode of the diode D2, and a second input terminal of the rectification and filtering circuit is common to both an anode of the diode D3 and a cathode of the diode D4; the balancing capacitor C1 is connected in series with one of the input terminals of the rectification and filtering circuit;

a positive terminal of a first LED load is connected with a cathode of the diode D1, and a negative terminal of the first LED load is connected with an anode of the diode D2; a positive terminal of the second LED load is connected with a cathode of the diode D3, and a negative terminal of the second LED load is connected with an anode of the diode D4;

the cathode of the diode D1 is connected with the cathode of the diode D3; the filter capacitors C2 and C3 are connected in parallel with the two LED loads respectively.

According to an embodiment of the present invention, a driving circuit for precise constant-current control of multiple LED branches is provided, including: a high-frequency pulse AC current source, and N circuit units provided for the high-frequency pulse AC current source, wherein all the circuit units have the same structure, and each of the circuit units includes a rectification and filtering circuit, a balancing capacitor C1 and two LED loads, with N being an integer greater than 1;

the rectification and filtering circuit includes two independent half-wave rectification circuits and two filter capacitors; each of the half-wave rectification circuits includes two diodes connected in series, for supplying electric power to one of the LED loads; each of the LED loads is connected in parallel with one of the filter capacitors; the balancing capacitor C1 is connected in series with an input terminal of the rectification and filtering circuit;

the driving circuit further includes N−1 current-balancing transformers, each of which is connected in series between two adjacent circuit units.

Preferably, the rectification and filtering circuit includes: a diode D1, a diode D2, a diode D3, a diode D4, a filter capacitor C2 and a filter capacitor C3;

a first input terminal of the rectification and filtering circuit is common to both an anode of the diode D1 and a cathode of the diode D2, and a second input terminal of the rectification and filtering circuit is common to both an anode of the diode D3 and a cathode of the diode D4; the balancing capacitor C1 is connected in series with one of the input terminals of the rectification and filtering circuit;

a positive terminal of a first LED load is connected with a cathode of the diode D1, and a negative terminal of the first LED load is connected with an anode of the diode D2; a positive terminal of a second LED load is connected with a cathode of the diode D3, and a negative terminal of the second LED load is connected with an anode of the diode D4;

the anode of the diode D2 is connected with the anode of the diode D4; the filter capacitors C2 and C3 are connected in parallel with the two LED loads respectively.

Preferably, the rectification and filtering circuit includes: a diode D1, a diode D2, a diode D3, a diode D4, a filter capacitor C2 and a filter capacitor C3;

a first input terminal of the rectification and filtering circuit is common to both an anode of the diode D1 and a cathode of the diode D2, and a second input terminal of the rectification and filtering circuit is common to both an anode of the diode D3 and a cathode of the diode D4; the balancing capacitor C1 is connected in series with one of the input terminals of the rectification and filtering circuit;

a positive terminal of a first LED load is connected with a cathode of the diode D1, and a negative terminal of the first LED load is connected with an anode of the diode D2; a positive terminal of the second LED load is connected with a cathode of the diode D3, and a negative terminal of the second LED load is connected with an anode of the diode D4;

the cathode of the diode D1 is connected with the cathode of the diode D3; the filter capacitors C2 and C3 are connected in parallel with the two LED loads respectively.

Preferably, the high-frequency pulse AC current source is connected directly with the N circuit units;

or, the high-frequency pulse AC current source is connected with the N circuit units via a transformer T2; the high-frequency pulse AC current source is connected with a primary winding of the transformer T2; the transformer T2 has N secondary windings, each of which is connected with one of the circuit units.

According to an embodiment of the present invention, a driving circuit for precise constant-current control of multiple LED branches is provided, including: a high-frequency pulse AC current source, and N+1 circuit units provided for the high-frequency pulse AC current source, wherein N of the circuit units have the same structure, and each of the N circuit units includes a rectification and filtering circuit, a balancing capacitor C1 and two LED loads; the (N+1)th circuit unit includes a rectification and filtering circuit and one LED load; N is an integer greater than or equal to 1;

the rectification and filtering circuit includes two independent half-wave rectification circuits and two filter capacitors; each of the half-wave rectification circuits includes two diodes connected in series, for supplying electric power to one LED load; each LED load is connected in parallel with one of the filter capacitors; the balancing capacitor C1 is connected in series with an input terminal of the rectification and filtering circuit;

the driving circuit further includes N current-balancing transformers, each of which is connected in series between two adjacent circuit units.

Preferably, the rectification and filtering circuit includes a diode D1, a diode D2, a diode D3, a diode D4, a filter capacitor C2 and a filter capacitor C3;

a first input terminal of the rectification and filtering circuit is common to both an anode of the diode D1 and a cathode of the diode D2, and a second input terminal of the rectification and filtering circuit is common to both an anode of the diode D3 and a cathode of the diode D4; the balancing capacitor C1 is connected in series with one of the input terminals of the rectification and filtering circuit;

a positive terminal of a first LED load is connected with a cathode of the diode D1, and a negative terminal of the first LED load is connected with an anode of the diode D2; a positive terminal of a second LED load is connected with a cathode of the diode D3, and a negative terminal of the second LED load is connected with an anode of the diode D4;

the anode of the diode D2 is connected with the anode of the diode D4; the filter capacitors C2 and C3 are connected in parallel with the two LED loads respectively.

Preferably, the rectification and filtering circuit includes a diode D1, a diode D2, a diode D3, a diode D4, a filter capacitor C2 and a filter capacitor C3;

a first input terminal of the rectification and filtering circuit is common to both an anode of the diode D1 and a cathode of the diode D2, and a second input terminal of the rectification and filtering circuit is common to both an anode of the diode D3 and a cathode of the diode D4; the balancing capacitor C1 is connected in series with one of the input terminals of the rectification and filtering circuit;

a positive terminal of a first LED load is connected with a cathode of the diode D1, and a negative terminal of the first LED load is connected with an anode of the diode D2; a positive terminal of the second LED load is connected with a cathode of the diode D3, and a negative terminal of the second LED load is connected with an anode of the diode D4;

the cathode of the diode D1 is connected with the cathode of the diode D3; the filter capacitors C2 and C3 are connected in parallel with the two LED loads respectively.

Preferably, the high-frequency pulse AC current source is connected directly with the N+1 circuit units;

or, the high-frequency pulse AC current source is connected with the N+1 circuit units via a transformer T2; the high-frequency pulse AC current source is connected with a primary winding of the transformer T2; the transformer T2 has N+1 secondary windings, each of which is connected with one of the circuit units.

The present invention can bring the following benefits:

1. Current balancing between multiple LED loads with one conversion stage, and hence low cost; without additional control circuits, which leads to high reliability.

2. High-precision current balancing regardless of the difference between the voltages across LED loads.

3. High-efficiency current balancing due to the balancing capacitor, and less loss even when the difference between the voltages across LED loads is large.

BRIEF DESCRIPTION OF THE DRAWINGS

The present invention will be described in detail in conjunction with the accompanying drawings and embodiments.

DETAILED DESCRIPTION OF THE EMBODIMENTS

Figure 1:
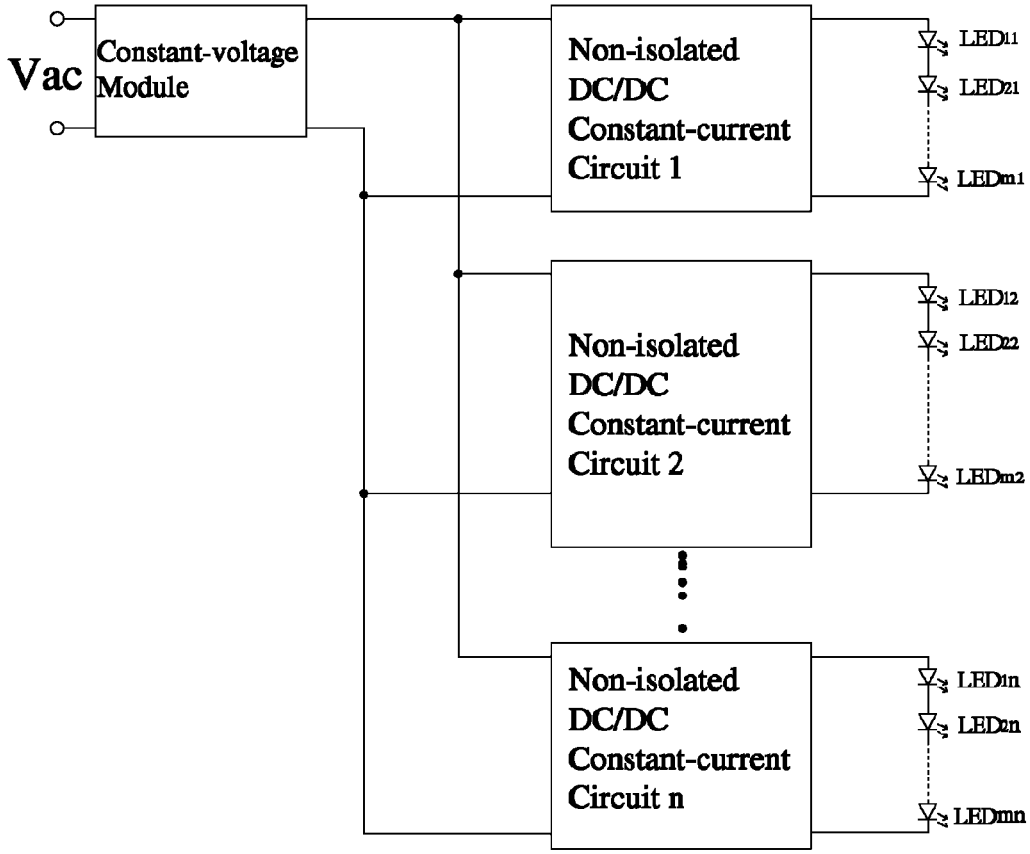
FIG. 1 is a schematic diagram illustrating a first multipath constant-current control driver in the prior art.
Figure 2:
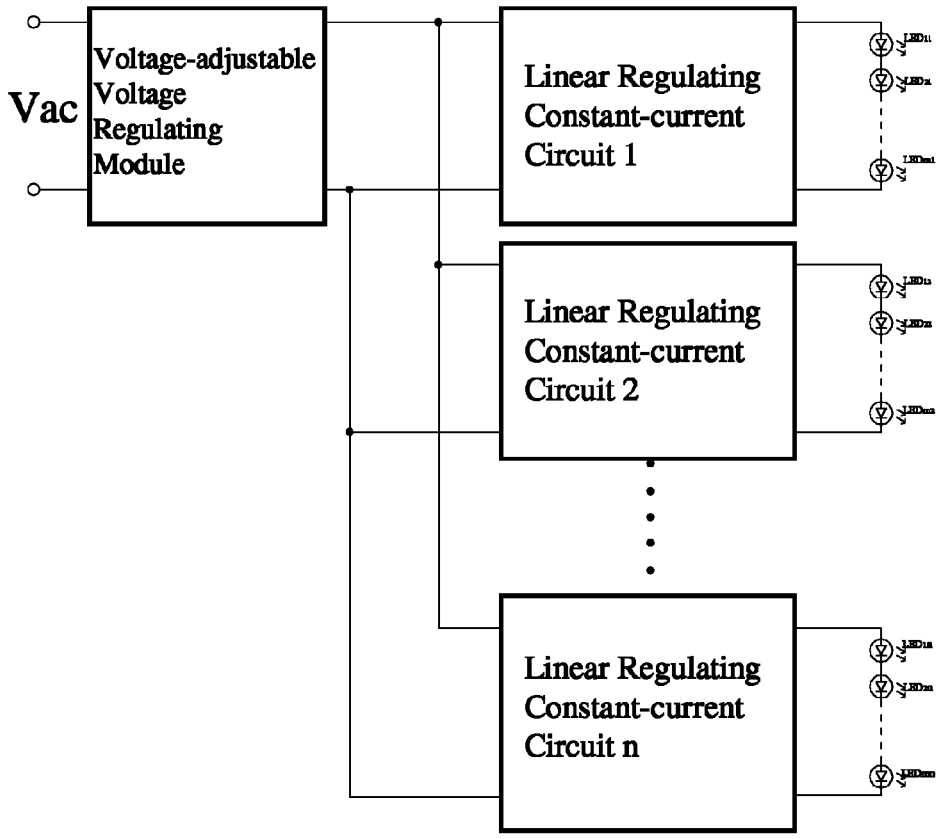
FIG. 2 is a schematic diagram illustrating a second multipath constant-current control driver in the prior art.
Figure 3:
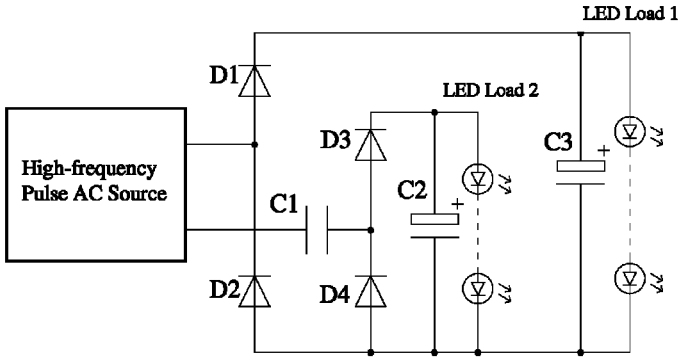
FIG. 3 is a schematic diagram illustrating a driving circuit for precise constant-current control of multiple LED branches according to a first embodiment of the invention.

FIG. 3 illustrates a driving circuit for precise constant-current control of multiple LED branches according to a first embodiment of the invention. The circuit shown in FIG. 3 is used for current balancing between two LED loads.

Specifically, the driving circuit for precise constant-current control of multiple LED branches includes a high-frequency pulse AC current source, a rectification and filtering circuit, a balancing capacitor C1 and two LED loads.

The rectification and filtering circuit includes two independent half-wave rectification circuits and two filter capacitors. The two half-wave rectification circuits have the same structure, and each includes two diodes connected in series. Each of the half-wave rectification circuits is used for supplying electric power to one of the LED loads. Each of the LED loads is connected in parallel with one of the filter capacitors. The balancing capacitor C1 is connected in series between an input terminal of the rectification and filtering circuit and the high-frequency pulse AC current source.

As shown in FIG. 3, one of the half-wave rectification circuits includes a diode D1 and a diode D4, for supplying electric power to an LED load 1; and the other of the half-wave rectification circuits includes a diode D3 and a diode D2, for supplying electric power to an LED load 2.

An output terminal of the high-frequency pulse AC current source is connected in series to the balancing capacitor C1, which is then connected to one of the two input terminals of the rectification and filtering circuit.

A first input terminal of the rectification and filtering circuit is common to both an anode of the diode D1 and a cathode of the diode D2, and a second input terminal of the rectification and filtering circuit is common to both an anode of the diode D3 and a cathode of the diode D4. A positive terminal of the LED load 1 is connected with a cathode of the diode D1, and a negative terminal of the LED load 1 is connected with an anode of the diode D2. A positive terminal of the LED load 2 is connected with a cathode of the diode D3, and a negative terminal of the LED load 2 is connected with an anode of the diode D4.

The anode of the diode D2 is connected with the anode of the diode D4. The filter capacitors C2 and C3 are connected in parallel with the two LED loads respectively.

As can be seen from FIG. 3, in the first embodiment, the negative terminal of the LED load 1 and the negative terminal of the LED load 2 are connected with each other, then both to a terminal common to the anode of the diode D2 and the anode of the diode D4. This can be referred to as a "common cathode" arrangement of the two LED loads.

Figure 4:
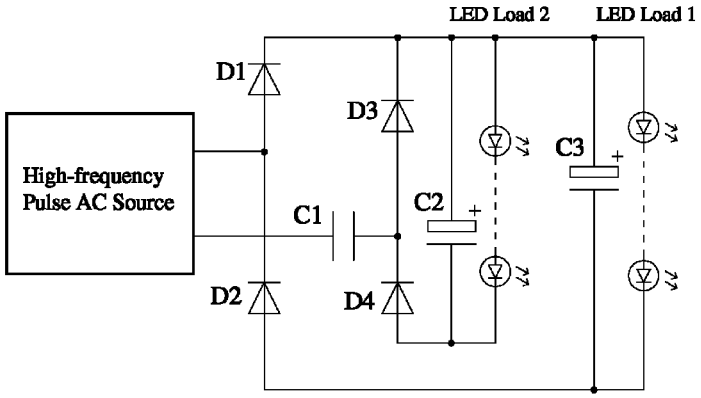
FIG. 4 is a schematic diagram illustrating a driving circuit for precise constant-current control of multiple LED branches according to a second embodiment of the invention.

FIG. 4 illustrates a driving circuit for precise constant-current control of multiple LED branches according to a second embodiment of the invention. The circuit shown in FIG. 4 is used for current balancing between two LED loads.

The circuit of the second embodiment differs from that of the first embodiment in that the arrangement of the two LED loads is "common anode".

As shown in FIG. 4, an output terminal of the high-frequency pulse AC current source is connected in series to the balancing capacitor C1, which is then connected to one of the two input terminals of the rectification and filtering circuit.

A first input terminal of the rectification and filtering circuit is common to both an anode of the diode D1 and a cathode of the diode D2, and a second input terminal of the rectification and filtering circuit is common to both an anode of the diode D3 and a cathode of the diode D4.

A positive terminal of the LED load 1 is connected with a cathode of the diode D1, and a negative terminal of the LED load 1 is connected with an anode of the diode D2. A positive terminal of the LED load 2 is connected with a cathode of the diode D3, and a negative terminal of the LED load 2 is connected with an anode of the diode D4.

The cathode of the diode D1 is connected with the cathode of the diode D3. The filter capacitors C2 and C3 are connected in parallel with the two LED loads respectively.

As can be seen from FIG. 4, in the second embodiment, the positive terminal of the LED load 1 and the positive terminal of the LED load 2 are connected with each other, then both to a terminal common to the cathode of the diode D1 and the cathode of the diode D3. This can be referred to as a "common anode" arrangement of the two LED loads.

The driving circuits for precise constant-current control of multiple LED branches according to the embodiments of the invention realize current balancing between two LED loads by a balancing capacitor C1, and the arrangement of the two LED loads may be "common cathode" or "common anode".

The circuit includes two independent half-wave rectification circuits, each of which consists of two diodes connected in series for supplying electric power to one of the two LED loads, and realizes filtering by a filter capacitor. Due to the presence of the balancing capacitor C1, when the voltage drops across the two LED loads are different, the difference between the voltages across the two LED loads can be balanced by the balancing capacitor C1, so that the average currents through the two LED loads are equal. In an ideal case where the voltage drops across the two LED loads are the same, the voltage across the balancing capacitor C1 is zero.

Figure 5:
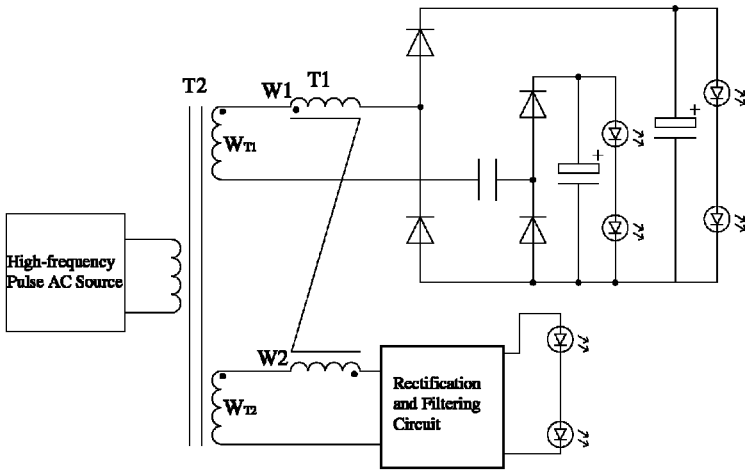
FIG. 5 is a schematic diagram illustrating a driving circuit for precise constant-current control of multiple LED branches according to a third embodiment of the invention.

FIG. 5 illustrates a driving circuit for precise constant-current control of multiple LED branches according to a third embodiment of the invention. The circuit shown in FIG. 5 is used for current balancing between three LED loads.

As shown in FIG. 5, the high-frequency pulse AC current source is connected with a primary winding of a transformer T2, and the transformer T2 has two secondary windings WT1 and WT2. The first secondary winding WT1 carries two LED loads, and the second secondary winding WT2 carries one LED load. Current balancing between the first secondary winding WT1 and the second secondary winding WT2 is realized by a current-balancing transformer T1.

The current-balancing transformer T1 includes two current-balancing windings W1 and W2. A dotted terminal of the first secondary winding WT1 is connected to a dotted terminal of the first current-balancing winding W1; and a non-dotted terminal of the first current-balancing winding W1 and a non-dotted terminal of the first secondary winding WT1 are connected in series to a balancing capacitor C1, as well as two rectification and filtering circuits and two LED loads. A dotted terminal of the second secondary winding WT2 is connected to a non-dotted terminal of the second current-balancing winding W2; and a dotted terminal of the second current-balancing winding W2 and a non-dotted terminal of the second secondary winding WT2 are connected to a third rectification and filtering circuit and a third LED load.

Current balancing between the two LED loads carried by the first secondary winding WT1 may be implemented in the manner shown in FIG. 3 or the manner shown in FIG. 4. However, balancing between the total current of the two LED loads and the current through the third LED load carried by the second secondary winding WT2 is realized by the current-balancing transformer T1. This is because currents in opposite directions flow through the two current-balancing windings W1 and W2 of the current-balancing transformer T1, and the voltage difference generated the winding automatically balances the two currents flowing through the current-balancing windings.

In the circuit shown in FIG. 5, the high-frequency pulse AC current source supplies electric power to three LED loads via the transformer T2. In each of the secondary windings of the transformer T2, a current which is in phase with the high-frequency pulse AC current source is generated; hence, the currents in the two secondary windings of the transformer T2 are in phase. This is equivalent to two high-frequency pulse AC current sources that are in phase supplying electric power to the circuits carried by respective secondary windings.

Figure 6:
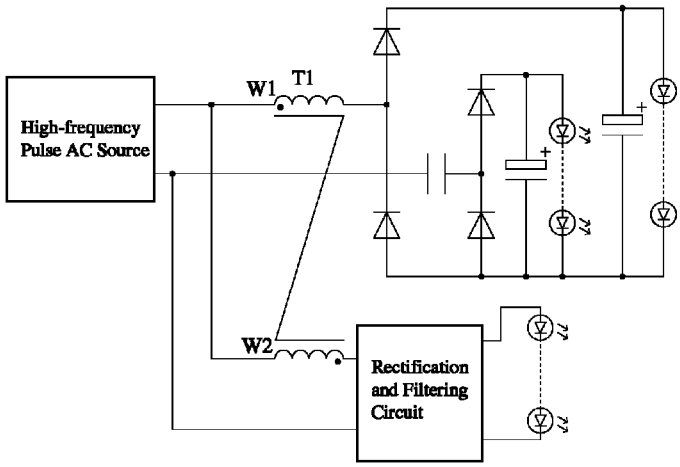
FIG. 6 is a schematic diagram illustrating a driving circuit for precise constant-current control of multiple LED branches according to a fourth embodiment of the invention.

FIG. 6 illustrates a driving circuit for precise constant-current control of multiple LED branches according to a fourth embodiment of the invention. The circuit shown in FIG. 6 is used for current balancing between three LED loads.

The circuit shown in FIG. 6 differs from that shown in FIG. 5 in that: there is no transformer T2, instead, the high-frequency pulse AC current source supplies electric power directly to the three LED loads.

As shown in FIG. 6, a terminal of the high-frequency pulse AC current source is connected to a dotted terminal of the first current-balancing winding W1 of the current-balancing transformer T1, and a non-dotted terminal of the first current-balancing winding W1 and the other terminal of the high-frequency pulse AC current source are connected to two rectification and filtering circuits and two LED loads; a terminal of the high-frequency pulse AC current source is connected to a non-dotted terminal of the second current-balancing winding W2, and a dotted terminal of the second current-balancing winding W2 and the other terminal of the high-frequency pulse AC current source are connected to a third rectification and filtering circuit and a third LED load.

The current balancing principle of the circuit shown in FIG. 6 is similar to that shown in FIG. 5.

Figure 7:
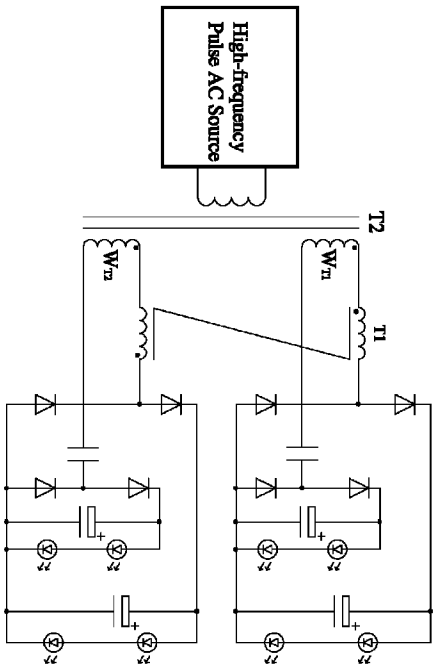
FIG. 7 is a schematic diagram illustrating a driving circuit for precise constant-current control of multiple LED branches according to a fifth embodiment of the invention.

FIG. 7 illustrates a driving circuit for precise constant-current control of multiple LED branches according to a fifth embodiment of the invention. The circuit shown in FIG. 7 is used for current balancing between four LED loads.

As shown in FIG. 7, the high-frequency pulse AC current source is connected with a primary winding of the transformer T2, and the transformer T2 has two secondary windings, each of which carries two LED loads. For each secondary winding, current balancing between the two LED loads may be implemented in the manner shown in FIG. 3 or the manner shown in FIG. 4. Current balancing between the two secondary windings is realized by the current-balancing transformer T1.

Figure 8:
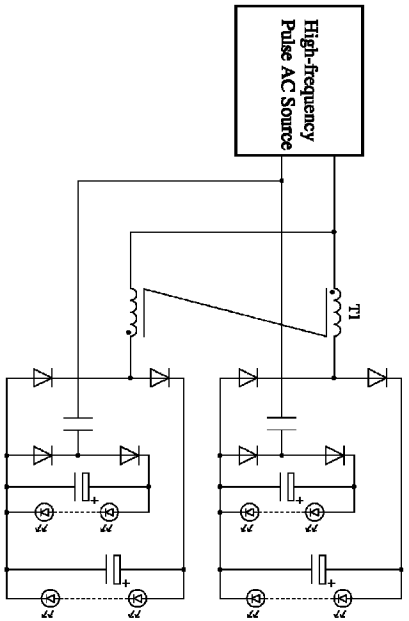
FIG. 8 is a schematic diagram illustrating a driving circuit for precise constant-current control of multiple LED branches according to a sixth embodiment of the invention.

FIG. 8 illustrates a driving circuit for precise constant-current control of multiple LED branches according to a sixth embodiment of the invention. The circuit shown in FIG. 8 is used for current balancing between four LED loads.

The circuit shown in FIG. 8 differs from that shown in FIG. 7 in that: There is no transformer T2, instead, the high-frequency pulse AC current source supplies electric power directly to the four LED loads. The current balancing principle is similar to that shown in FIG. 7.

Figure 9:
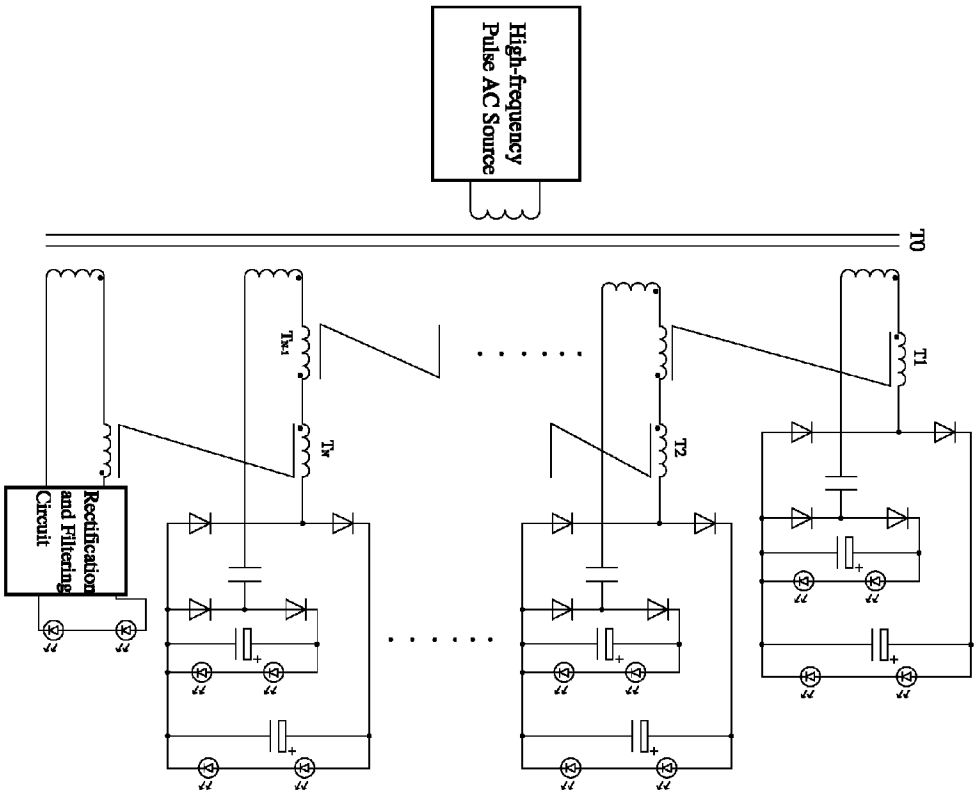
FIG. 9 is a schematic diagram illustrating a driving circuit for precise constant-current control of multiple LED branches according to a seventh embodiment of the invention.

FIG. 9 illustrates a driving circuit for precise constant-current control of multiple LED branches according to a seventh embodiment of the invention. The circuit shown in FIG. 9 is used for current balancing between an odd number of LED loads, and is an extension based on the circuit shown in FIG. 5. The high-frequency pulse AC current source is connected with a primary winding of a transformer T0.

Assuming that the number of LED loads is 2N+1, the transformer T0 has N+1 secondary windings. Each of N of the N+1 secondary windings is connected with a circuit unit. The circuit units have the same structure, and each includes a rectification and filtering circuit, a balancing capacitor C1 and two LED loads. This structure is the same as that of the first embodiment, and detailed description is therefore omitted. The (N+1)th secondary winding is connected with a rectification and filtering circuit and one LED load.

It is noted that in the circuit of the seventh embodiment, current balancing between two LED loads connected in parallel with the same secondary winding may be implemented in the manner shown in FIG. 3, or the manner shown in FIG. 4, or a manner combining both. Current balancing between the N+1 secondary windings is realized by N current-balancing transformers.

In the circuit shown in FIG. 9, the output currents of the secondary windings of the transformer T0 are in phase. A current-balancing transformer is arranged between every two adjacent circuit units, and each of the two adjacent circuits is connected in series with a current-balancing winding of the current-balancing transformer; hence, currents that are in phase flow through a dotted terminal of a current-balancing winding and a non-dotted terminal of the other current-balancing winding. When the transformation ratio of the current-balancing transformer is n:m and the ratio between the currents flowing through a dotted terminal of a current-balancing winding and a non-dotted terminal of the other current-balancing winding is not m:n, the magnetizing current of the current-balancing transformer is not zero. The magnetizing current generates an voltage across the current-balancing transformer which automatically balances the difference between the voltages of the two circuit units, making the ratio between the currents in the two windings of the current-balancing transformer to be m:n, thereby realizing balancing control of the currents of the two circuit units, especially when m=n, realizing current balancing between the two circuit units.

Therefore, current balancing between the N circuit units shown in FIG. 9 is realized in the same manner by N−1 current-balancing transformers, with N being a positive integer greater than or equal to 2.

In the driving circuit for precise constant-current control of an odd number of LED branches according to the invention, each of the N−1 circuit units with the same structure includes a balancing capacitor for current balancing between the two LED loads in the circuit unit. Moreover, balancing control of the total currents of two adjacent circuit units is realized by a current-balancing transformer; hence, by N−1 current-balancing transformers, balancing is achieved between the total currents of every two adjacent circuit units, thereby realizing current balancing between all the circuit units.

Figure 10:
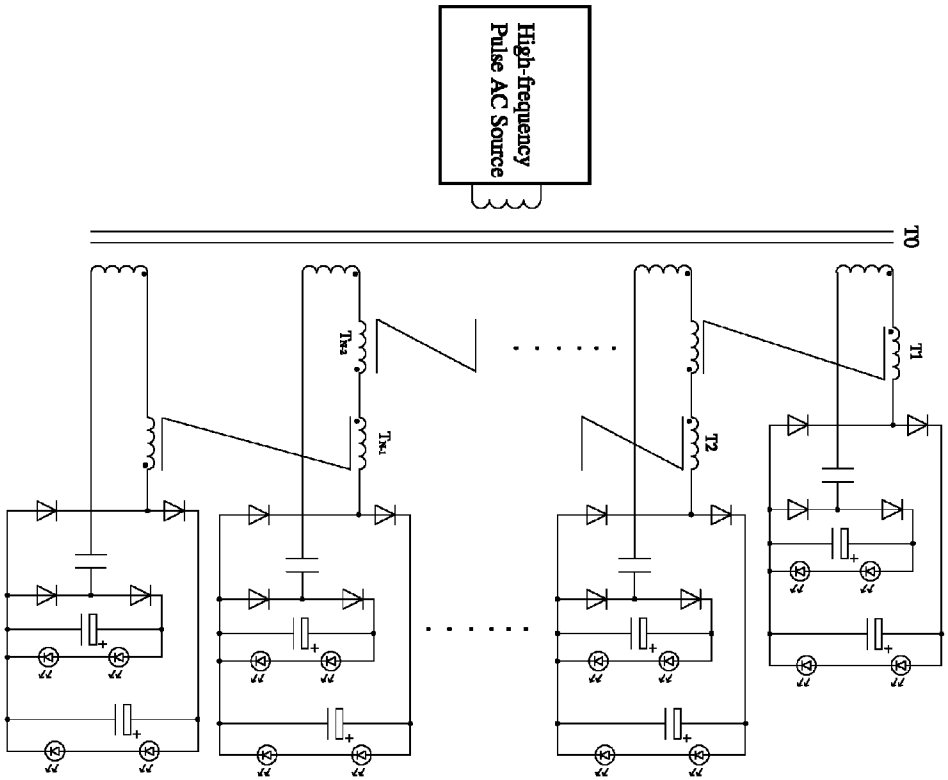
FIG. 10 is a schematic diagram illustrating a driving circuit for precise constant-current control of multiple LED branches according to an eighth embodiment of the invention.

FIG. 10 illustrates a driving circuit for precise constant-current control of multiple LED branches according to an eighth embodiment of the invention. The circuit shown in FIG. 10 is used for current balancing between an even number of LED loads, and is an extension based on the circuit shown in FIG. 6. The high-frequency pulse AC current source is connected with a primary winding of the transformer T0.

Assuming that the number of LED loads is 2N, the transformer T0 has N secondary windings, each of which is connected with a circuit unit. The circuit units connected with respective secondary windings have the same structure, and each includes a rectification and filtering circuit, a balancing capacitor C1 and two LED loads. This structure is the same as that of the first embodiment, and detailed description is therefore omitted.

It is noted that in the circuit of the eighth embodiment, current balancing between two LED loads connected in parallel with the same secondary winding may be implemented in the manner shown in FIG. 3, or the manner shown in FIG. 4, or a manner combining both. Current balancing between the N secondary windings is realized by N−1 current-balancing transformers.

In the circuit shown in FIG. 10, the output currents of the secondary windings of the transformer T0 are in phase. A current-balancing transformer is arranged between every two adjacent circuit units, and each of the two adjacent circuits is connected in series with a current-balancing winding of the current-balancing transformer; hence, currents that are in phase flow through a dotted terminal of a current-balancing winding and a non-dotted terminal of the other current-balancing winding. When the transformation ratio of the current-balancing transformer is n:m and the ratio between the currents flowing through a dotted terminal of a current-balancing winding and a non-dotted terminal of the other current-balancing winding is not m:n, the magnetizing current of the current-balancing transformer is not zero. The magnetizing current generates an voltage across the current-balancing transformer which automatically balances the difference between the voltages of the two circuit units, making the ratio between the currents in the two windings of the current-balancing transformer to be m:n, thereby realizing balancing control of the currents of the two circuit units, especially when m=n, realizing current balancing between the two circuit units.

Therefore, current balancing between the N circuit units shown in FIG. 10 is realized in the same manner by N−1 current-balancing transformers, with N being a positive integer greater than or equal to 2.

In the driving circuit for precise constant-current control of an even number of LED branches according to the invention, a balancing capacitor realizes current balancing between the two LED loads in each of the circuit units. Moreover, balancing control of the total currents of two adjacent circuit units is realized by a current-balancing transformer; hence, by N−1 current-balancing transformers, balancing is achieved between the total currents of every two adjacent circuit units, thereby realizing current balancing between all the circuit units.

In FIG. 9 and FIG. 10 above, instead of via a transformer T2, the high-frequency pulse AC current source supplies electric power directly to the 2N+1 or 2N LED loads, resulting in extensions of FIG. 6 and FIG. 8, respectively. In addition, the circuits shown in FIG. 5 and FIG. 6 may be used in combination, as well as the circuits shown in FIG. 7 and FIG. 8.

Figure 11:
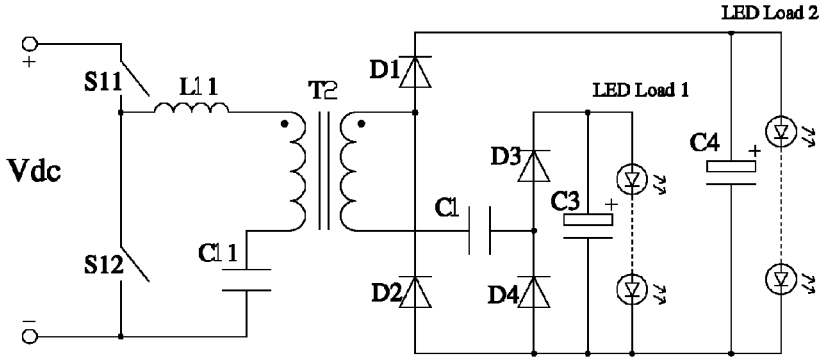
FIG. 11 is a schematic diagram illustrating a driving circuit for precise constant-current control of multiple LED branches according to a ninth embodiment of the invention.

FIG. 11 illustrates a driving circuit for precise constant-current control of multiple LED branches according to a ninth embodiment of the invention. The circuit shown in FIG. 11 is used for current balancing between two LED loads where the high-frequency pulse AC current source is based on an LLC resonant circuit as an example.

The high-frequency pulse AC current source includes a DC voltage Vdc, a switching tube S11, a switching tube S12, an inductor L11 and a capacitor C11. Specifically, a positive terminal of the DC voltage Vdc is connected to a first terminal of the switching tube S11; a second terminal of the switching tube S11 is connected to a first terminal of the switching tube S12 and a terminal of the inductor L11; a second terminal of the switching tube S12 is connected to a negative terminal of the DC voltage Vdc and a terminal of the capacitor C11; the other terminal of the inductor L11 is connected to a dotted terminal of a primary winding of a main transformer T2; and a non-dotted terminal of the primary winding of the main transformer T2 is connected to the other terminal of the capacitor C11.

A dotted terminal of a secondary winding of the main transformer T2 is connected to an anode of a diode D1 and a cathode of a diode D2; a non-dotted terminal of the secondary winding is connected to a terminal of a balancing capacitor C1; the other terminal of the balancing capacitor C1 is connected to an anode of a diode D3 and a cathode of a diode D4; a cathode of the diode D1 is connected to a positive terminal of an electrolytic capacitor C4 and a positive terminal of an LED load 2; a cathode of the diode D3 is connected to a positive terminal of an electrolytic capacitor C3 and a positive terminal of an LED load 1; and an anode of the diode D2 is connected to an anode of the diode D4, a negative terminal of the electrolytic capacitor C3, a negative terminal of the LED load 1, a negative terminal of the electrolytic capacitor C4 and a negative terminal of the LED load 2.

Figure 12:
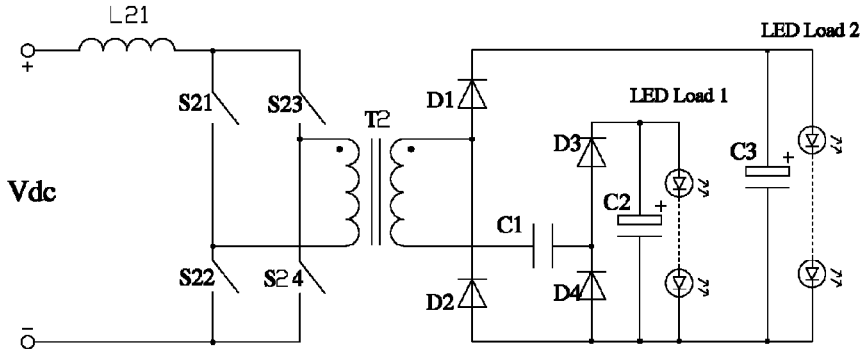
FIG. 12 is a schematic diagram illustrating a driving circuit for precise constant-current control of multiple LED branches according to a tenth embodiment of the invention.

FIG. 12 illustrates a driving circuit for precise constant-current control of multiple LED branches according to a tenth embodiment of the invention. The circuit shown in FIG. 12 is used for current balancing between two LED loads where the high-frequency pulse AC current source is based on a full-bridge circuit as an example.

The high-frequency pulse AC current source includes a DC voltage Vdc, a switching tube S21, a switching tube S22, a switching tube S23, a switching tube S24 and an inductor L21. Specifically, a positive terminal of the DC voltage Vdc is connected with both a first terminal of the switching tube S21 and a first terminal of the switching tube S23 via the inductor L21; a second terminal of the switching tube S21 is connected to a first terminal of the switching tube S22 and a non-dotted terminal of a primary winding of a main transformer T2; a second terminal of the switching tube S23 is connected to a first terminal of the switching tube S24 and a dotted terminal of the primary winding of the main transformer T2; and a second terminal of the switching tube S22 is connected to a negative terminal of the DC voltage Vdc and a second terminal of the switching tube S24.

A dotted terminal of a secondary winding of the main transformer T2 is connected to an anode of a diode D1 and a cathode of a diode D2; a non-dotted terminal of the secondary winding is connected to a terminal of a balancing capacitor C1; the other terminal of the balancing capacitor C1 is connected to an anode of a diode D3 and a cathode of a diode D4; a cathode of the diode D1 is connected to a positive terminal of an electrolytic capacitor C3 and a positive terminal of an LED load 2; a cathode of the diode D3 is connected to a positive terminal of an electrolytic capacitor C2 and a positive terminal of an LED load 1; and an anode of the diode D2 is connected to an anode of the diode D4, a negative terminal of the electrolytic capacitor C2, a negative terminal of the LED load 1, a negative terminal of the electrolytic capacitor C3 and a negative terminal of the LED load 2.

Figure 13:
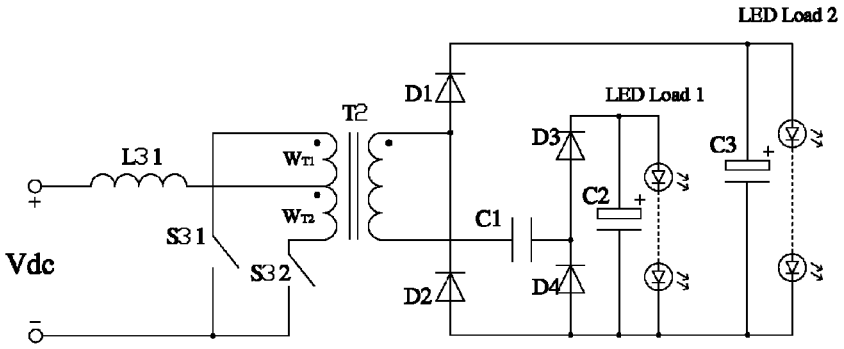
FIG. 13 is a schematic diagram illustrating a driving circuit for precise constant-current control of multiple LED branches according to an eleventh embodiment of the invention.

FIG. 13 illustrates a driving circuit for precise constant-current control of multiple LED branches according to an eleventh embodiment of the invention. The circuit shown in FIG. 13 is used for current balancing between two LED loads where the high-frequency pulse AC current source is based on a push-pull circuit as an example.

As shown in FIG. 13, a main transformer T2 has two primary windings $W_{T1}$ and $W_{T2}$, and a non-dotted terminal of the first primary windings $W_{T1}$ is connected with a dotted terminal of the second primary windings $W_{T2}$.

The high-frequency pulse AC current source includes a DC voltage Vdc, a switching tube S31, a switching tube S32 and an inductor L31. Specifically, a positive terminal of the DC voltage Vdc is connected with the non-dotted terminal of the first primary winding $W_{T1}$ (i.e., and the dotted terminal of the second primary winding $W_{T2}$) via the inductor L31; a dotted terminal of the first primary winding $W_{T1}$ is connected to a first terminal of the switching tube S31; a second terminal of the switching tube S31 is connected to a negative terminal of the DC voltage Vdc; a non-dotted terminal of the second primary winding $W_{T2}$ is connected to a first terminal of the switching tube S32; and a second terminal of the switching tube S32 is connected with the negative terminal of the DC voltage Vdc.

A dotted terminal of a secondary winding of the main transformer T2 is connected to an anode of a diode D1 and a cathode of the diode D2; a non-dotted terminal of the secondary winding is connected to a terminal of a balancing capacitor C1; the other terminal of the balancing capacitor C1 is connected to an anode of a diode D3 and a cathode of a diode D4; a cathode of the diode D1 is connected to a positive terminal of an electrolytic capacitor C3 and a positive terminal of an LED load 2; a cathode of the diode D3 is connected to a positive terminal of an electrolytic capacitor C2 and a positive terminal of an LED load 1; and an anode of the diode D2 is connected to an anode of the diode D4, a negative terminal of the electrolytic capacitor C2, a negative terminal of the LED load 1, a negative terminal of the electrolytic capacitor C3 and a negative terminal of the LED load 2.

Figure 14:
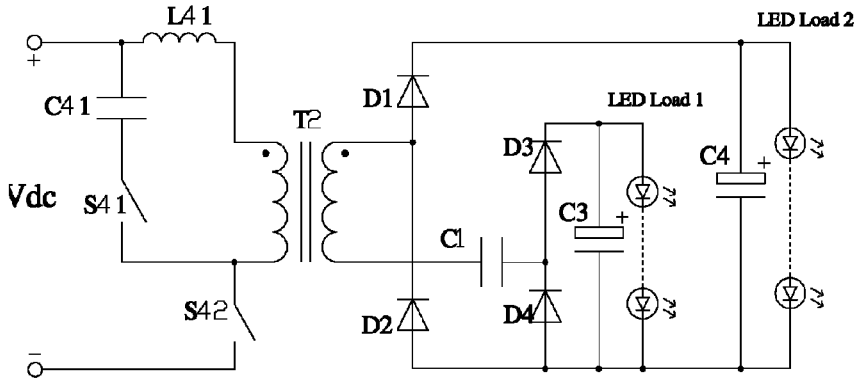
FIG. 14 is a schematic diagram illustrating a driving circuit for precise constant-current control of multiple LED branches according to a twelfth embodiment of the invention.

FIG. 14 illustrates a driving circuit for precise constant-current control of multiple LED branches according to a twelfth embodiment of the invention. The circuit shown in FIG. 14 is used for current balancing between two LED loads where the high-frequency pulse AC current source is based on a forward circuit as an example.

The high-frequency pulse AC current source includes a DC voltage Vdc, a switching tube S41, a switching tube S42, an inductor L41 and a capacitor C41. Specifically, a positive terminal of the DC voltage Vdc is connected to a terminal of the inductor L41 and a terminal of the capacitor C41; the other terminal of the inductor L41 is connected to a dotted terminal of a primary winding of a main transformer T2; the other terminal of the capacitor C41 is connected to a first terminal of the switching tube S41; a second terminal of the switching tube S41 is connected to a non-dotted terminal of the primary winding of the main transformer T2 and a first terminal of the switching tube S42; and a second terminal of the switching tube S42 is connected to a negative terminal of the DC voltage Vdc.

A dotted terminal of a secondary winding of the main transformer T2 is connected to an anode of a diode D1 and a cathode of a diode D2; a non-dotted terminal of the secondary winding is connected to a terminal of a balancing capacitor C1; the other terminal of the balancing capacitor C1 is connected to an anode of a diode D3 and a cathode of a diode D4; a cathode of the diode D1 is connected to a positive terminal of an electrolytic capacitor C4 and a positive terminal of an LED load 2; a cathode of the diode D3 is connected to a positive terminal of an electrolytic capacitor C3 and a positive terminal of an LED load 1; and an anode of the diode D2 is connected to an anode of the diode D4, a negative terminal of the electrolytic capacitor C3, a negative terminal of the LED load 1, a negative terminal of the electrolytic capacitor C4 and a negative terminal of the LED load 2.

It is noted that the specific embodiments of the present invention described above are for illustrative purposes only. As a matter of course, the present invention is not limited to the embodiments above, but may include various variations. All the variations that those skilled in the art can make or derive directly from the disclosure of the present invention shall fall with the scope of protection of the present invention.

The invention claimed is:

1. A driving circuit for precise constant-current control of multiple LED branches, comprising: a high-frequency pulse Alternating Current (AC) source, and a circuit unit provided for the high-frequency pulse AC source, wherein, the circuit unit comprises a rectification and filtering circuit, a balancing capacitor and two LED loads; and the rectification and filtering circuit comprises two independent half-wave rectification circuits and two filter capacitors; each of the half-wave rectification circuits comprises two diodes connected in series, for supplying electric power to one of the LED loads; each of the LED loads is connected in parallel with one of the filter capacitors; the balancing capacitor is connected in series with an input terminal of the rectification and filtering circuit, wherein:

the rectification and filtering circuit comprises a first diode, a second diode, a third diode, a fourth diode, a first filter capacitor and a second filter capacitor;

the first input terminal of the rectification and filtering circuit is common to both an anode of the first diode and a cathode of the second diode, and the second input terminal of the rectification and filtering circuit is common to both an anode of the third diode and a cathode of the fourth diode; the balancing capacitor is connected in series with one of the input terminals of the rectification and filtering circuit;

a positive terminal of a first LED load is connected with a cathode of the first diode, and a negative terminal of the first LED load is connected with an anode of the second diode; a positive terminal of a second LED load is connected with a cathode of the third diode, and a negative terminal of the second LED load is connected with an anode of the fourth diode; and the anode of the second diode is connected with the anode of the fourth diode or the cathode of the first diode is connected with the cathode of the third diode; the first and second filter capacitors are connected in parallel with the two LED loads respectively.

2. A driving circuit for precise constant-current control of multiple LED branches, comprising: a high-frequency pulse AC source, and N circuit units provided for the high-frequency pulse AC source, wherein, all the circuit units have the same structure, and each of the circuit units comprises a rectification and filtering circuit, a balancing capacitor and two LED loads, with N being an integer greater than 1; and wherein:

the rectification and filtering circuit comprises two independent half-wave rectification circuits and two filter capacitors; each of the half-wave rectification circuits comprises two diodes connected in series, for supplying electric power to one of the LED loads; each of the LED loads is connected in parallel with one of the filter capacitors; the balancing capacitor is connected in series with an input terminal of the rectification and filtering circuit; and the driving circuit further comprises N−1 current-balancing transformers, each current-balancing transformer is connected in series between two adjacent circuit units, and one of two windings of each current-balancing transformer is connected with one of the two adjacent circuit units while the other one of the two windings of each current-balancing transformer is connected with the other one of the two adjacent circuit units.

3. The driving circuit for precise constant-current control of multiple LED branches according to claim 2, wherein, the rectification and filtering circuit comprises: a first diode, a second diode, a third diode, a fourth diode, a first filter capacitor and a second filter capacitor;

a first input terminal of the rectification and filtering circuit is common to both an anode of the first diode and a cathode of the second diode, and a second input terminal of the rectification and filtering circuit is common to both an anode of the third diode and a cathode of the fourth diode; the balancing capacitor is connected in series with one of the input terminals of the rectification and filtering circuit;

a positive terminal of a first LED load is connected with a cathode of the first diode, and a negative terminal of the first LED load is connected with an anode of the second diode; a positive terminal of a second LED load is connected with a cathode of the third diode, and a negative terminal of the second LED load is connected with an anode of the fourth diode; and the anode of the second diode is connected with the anode of the fourth diode; the first and second filter capacitors are connected in parallel with the two LED loads respectively.

4. The driving circuit for precise constant-current control of multiple LED branches according to claim 3, wherein, the high-frequency pulse AC source is connected directly with the N circuit units;

or, the high-frequency pulse AC source is connected with the N circuit units via a transformer; the high-frequency pulse AC source is connected with a primary winding of the transformer; the transformer has N secondary windings, each of which is connected with one of the circuit units.

5. The driving circuit for precise constant-current control of multiple LED branches according to claim 2, wherein, the rectification and filtering circuit comprises: a first diode, a second diode, a third diode, a fourth diode, a first filter capacitor and a second filter capacitor;

a first input terminal of the rectification and filtering circuit is common to both an anode of the first diode and a cathode of the second diode, and a second input terminal of the rectification and filtering circuit is common to both an anode of the third diode and a cathode of the fourth diode; the balancing capacitor is connected in series with one of the input terminals of the rectification and filtering circuit;

a positive terminal of a first LED load is connected with a cathode of the first diode, and a negative terminal of the first LED load is connected with an anode of the second diode; a positive terminal of the second LED load is connected with a cathode of the third diode, and a negative terminal of the second LED load is connected with an anode of the fourth diode; and the cathode of the first diode is connected with the cathode of the third diode; the first and second filter capacitors are connected in parallel with the two LED loads respectively.

6. The driving circuit for precise constant-current control of multiple LED branches according to claim 5, wherein, the high-frequency pulse AC source is connected directly with the N circuit units;

or, the high-frequency pulse AC source is connected with the N circuit units via a transformer; the high-frequency pulse AC source is connected with a primary winding of the transformer; the transformer has N secondary windings, each of which is connected with one of the circuit units.

7. A driving circuit for precise constant-current control of multiple LED branches, comprising: a high-frequency pulse AC source, and N+1 circuit units provided for the high-frequency pulse AC source, wherein, N of the circuit units have the same structure, and each of the N circuit units comprises a rectification and filtering circuit, a balancing capacitor and two LED loads; the (N+1)th circuit unit comprises a rectification and filtering circuit and one LED load; N is an integer greater than or equal to 1; and wherein:

the rectification and filtering circuit comprises two independent half-wave rectification circuits and two filter capacitors; each of the half-wave rectification circuits comprises two diodes connected in series, for supplying electric power to one LED load; each LED load is connected in parallel with one of the filter capacitors; the balancing capacitor is connected in series with an input terminal of the rectification and filtering circuit; and the driving circuit further comprises N current-balancing transformers, each current-balancing transformer is connected in series between two adjacent circuit units, and one of two windings of each current-balancing transformer is connected with one of the two adjacent circuit units while the other one of the two windings of each current-balancing transformer is connected with the other one of the two adjacent circuit units.

8. The driving circuit for precise constant-current control of multiple LED branches according to claim 7, wherein, the rectification and filtering circuit comprises a first diode, a second diode, a third diode, a fourth diode, a first filter capacitor and a second filter capacitor;

a first input terminal of the rectification and filtering circuit is common to both an anode of the first diode and a cathode of the second diode, and a second input terminal of the rectification and filtering circuit is common to both an anode of the third diode and a cathode of the fourth diode; the balancing capacitor is connected in series with one of the input terminals of the rectification and filtering circuit;

a positive terminal of a first LED load is connected with a cathode of the first diode, and a negative terminal of the first LED load is connected with an anode of the second diode; a positive terminal of a second LED load is connected with a cathode of the third diode, and a negative terminal of the second LED load is connected with an anode of the fourth diode; and the anode of the second diode is connected with the anode of the fourth diode; the first and second filter capacitors are connected in parallel with the two LED loads respectively.

9. The driving circuit for precise constant-current control of multiple LED branches according to claim 8, wherein, the high-frequency pulse AC source is connected directly with the N+1 circuit units;

or, the high-frequency pulse AC source is connected with the N+1 circuit units via a transformer; the high-frequency pulse AC source is connected with a primary winding of the transformer; the transformer has N+1 secondary windings, each of which is connected with one of the circuit units.

10. The driving circuit for precise constant-current control of multiple LED branches according to claim 7, wherein, the rectification and filtering circuit comprises a first diode, a second diode, a third diode, a fourth diode, a first filter capacitor and a second filter capacitor;

a first input terminal of the rectification and filtering circuit is common to both an anode of the first diode and a cathode of the second diode, and a second input terminal of the rectification and filtering circuit is common to both an anode of the third diode and a cathode of the fourth diode; the balancing capacitor is connected in series with one of the input terminals of the rectification and filtering circuit;

a positive terminal of a first LED load is connected with a cathode of the first diode, and a negative terminal of the first LED load is connected with an anode of the second diode; a positive terminal of the second LED load is connected with a cathode of the third diode, and a negative terminal of the second LED load is connected with an anode of the fourth diode; and the cathode of the first diode is connected with the cathode of the third diode; the first and second filter capacitors are connected in parallel with the two LED loads respectively.

11. The driving circuit for precise constant-current control of multiple LED branches according to claim 10, wherein, the high-frequency pulse AC source is connected directly with the N+1 circuit units;

or, the high-frequency pulse AC source is connected with the N+1 circuit units via a transformer; the high-frequency pulse AC source is connected with a primary winding of the transformer; the transformer has N+1 secondary windings, each of which is connected with one of the circuit units.

* * * * *

UNITED STATES PATENT AND TRADEMARK OFFICE

CERTIFICATE OF CORRECTION

PATENT NO. : 8,866,394 B2
APPLICATION NO. : 13/519476
DATED : October 21, 2014
INVENTOR(S) : Xinke Wu et al.

It is certified that error appears in the above-identified patent and that said Letters Patent is hereby corrected as shown below:

Title page item (73), Delete "Inventronics (Hangzhou) Co., Ltd." and insert
--Inventronics (Hangzhou), Inc.--.

Signed and Sealed this
Eighth Day of September, 2015

Michelle K. Lee

Michelle K. Lee
*Director of the United States Patent and Trademark Office*